United States Patent [19]

Shlykov et al.

[11] 4,296,528

[45] Oct. 27, 1981

[54] DRAWING MECHANISM

[76] Inventors: Gennady N. Shlykov, Chilanzar, kvartal 19, 31 kv. 3; Vitaly I. Zhestkov, Chilanzar, kvartal 19, 26, kv. 41; Valentin N. Tikhonov, ulitsa Shota Rustaveli, 55, kv. 28; Vasily M. Dyachkov, Kuiljuk - 4, 23-a, kv. 11; Vladimir G. Glazov, Chilanzar, kvartal 19, 58, kv. 25, all of Tashkent; Timur P. Krjuk, prospekt Mira, 90, kv. 11, Moscow, all of U.S.S.R.

[21] Appl. No.: 47,054

[22] Filed: Jun. 11, 1979

[30] Foreign Application Priority Data

Jul. 13, 1978 [SU] U.S.S.R. ..... 2643332

[51] Int. Cl.[3] ..... D01H 5/88

[52] U.S. Cl. ..... 19/255; 57/58.89; 57/58.95; 57/80

[58] Field of Search ..... 19/244, 246, 248, 249, 19/254, 255, 256, 284, 294, 295; 57/58.89, 58.95, 80

[56] References Cited

U.S. PATENT DOCUMENTS

| | | | |
|---|---|---|---|
| 1,254,390 | 1/1918 | Casablancas | 19/248 |
| 2,675,585 | 4/1954 | Naegeli | 19/254 |
| 2,688,778 | 9/1954 | Kalwaites | 19/263 X |
| 2,696,026 | 12/1954 | Noguera | 19/255 |
| 3,160,924 | 12/1964 | Cole | 19/255 X |
| 3,359,713 | 12/1967 | Keyser | 19/246 |
| 3,462,936 | 8/1969 | Boucek et al. | 57/80 |
| 3,890,677 | 6/1975 | Noguera | 19/255 |

FOREIGN PATENT DOCUMENTS

| | | |
|---|---|---|
| 1189897 | 11/1965 | Fed. Rep. of Germany . |
| 2094211 | 2/1972 | France . |

*Primary Examiner*—Louis Rimrodt

*Attorney, Agent, or Firm*—Lackenbach, Lilling & Siegel

[57] ABSTRACT

The drawing mechanism comprises a housing accommodating a feed couple defined by a pair of endless belts. One endless belt is mounted about a driving cylinder, and moves in engagement with a movable guide and transmits motion to the other belt running about the pressure roller of the feed couple and said other belt moves in engagement with a stationary guide, and the drawing mechanism also includes a delivery couple defined by its own driving cylinder and its own pressure roller. At the inlet of the feed couple there are mounted a guiding member and a compacting member adapted to precompact the fibrous product being fed into the feed couple. The pressure roller of the delivery couple and the pressure roller of the feed couple, the stationary guide of the feed couple, the compacting and guiding members are mounted on a common removable plate provided with an adjustable retainer means for retaining the common removable plate in its position.

7 Claims, 7 Drawing Figures

DRAWING MECHANISM

BACKGROUND OF THE INVENTION

The present invention relates to textile engineering, and more particularly it relates to drawing mechanisms of textile machines, and the invention can be utilized most effectively in ringless spinning frames.

Drawing mechanisms incorporated in spinning, draw, etc. frames comprise a rotatable feed couple and a rotatable delivery couple between which the fibrous feed material is drawn and thinned, this feed material being sliver, roving, etc. The ratio of the speeds of the feed and delivery couples defines the draft of the fibrous material. The feed couple includes a feed cylinder rotatable by a drive motor, an endless bottom belt running about this feed cylinder and being rotatable thereby, and a known per se guide engaged by this belt.

Furthermore, the feed couple includes an elastic pressure roller about which runs the top belt rotatable by the friction engagement with the bottom belt. The top belt also runs about a movable guide of the belts (cf. the FR Pat. No. 2,094,211 and the FRG Pat. No. 1,189,897). The fibrous material is made to pass between the bottom and top belts.

The delivery couple includes a delivery cylinder driven from an independent drive motor and an elastic pressure roller maintained in friction engagement with the delivery cylinder.

As a rule, in spinning frames the feed cylinders are integral structures extending the entire length of the frame, while the pressure rollers with the movable guides are mounted in pairs, one pair for one working station. The maintenance of a machine of this type is impeded; thus, to replace worn bottom belts, it is necessary to dismantle the entire feed cylinder line. Besides, the replacement of worn top belts serving one working station results in idling of the adjacent working station paired with the first-mentioned one with respect of the top belts. This makes for the simplicity of high-efficiency equipment.

There are known drawing mechanisms (cf. the U.S. Pat. No. 3,359,713, Cl. 57-36, dated 1966) comprising a housing and a feed couple defined by two endless belts, and a delivery couple, mounted in a cantilever fashion per each working station. One of the endless belts, namely, the bottom one, is mounted on its own feed cylinder and drives for rotation the other belt, the top one, mounted on the pressure roller of this couple. The delivery couple has its own driving cylinder and its own pressure roller. The feed couple further includes a stationary bottom belt guide and a movable top belt guide about which the respective belts are adapted to run in engagement therewith. Mounted at the inlet of the feed couple is a compacting device adapted to precompact the fibrous feed material. The feed and delivery couples are rigidly fixed in the housing, the spacing of their centers being short of the sum of their radii. This provides the loading of the feed and delivery cylinders, owing to the effort of the deformation of the resilient coatings of the pressure rollers.

This structure of the drawing mechanism is not, however, free from serious disadvantages arising from the fact that should the fibrous material become wound about the pressure rollers, which situation might take place in drawing mechanisms on account of sticking of fibres or strands of fibres, caused by their being electrically charged, or greased, or polluted, this would lead to an emergency seriously affecting the drawing process and its stability and complicating the maintenance of the drawing mechanism.

This feature negatively affects the operation of the machine, as a whole, and brings down its output, by reducing its time utilization factor.

SUMMARY OF THE INVENTION

It is the main object of the present invention to create a drawing mechanism which provides for a simplified and convenient removal of the pressure rollers and belts, particularly, in cases where the fibrous material becomes wound about the pressure rollers.

It is another object of the present invention to enhance the reliability and durability of a drawing mechanism.

It is yet another object of the present invention to improve the time utilization factor of a spinning machine.

These and other objects are attained in a drawing mechanism comprising a housing accommodating a feed couple defined by a pair of endless belts. One endless belt is mounted about a driving cylinder and moves in engagement with a movable guide, this one belt being adapted to drive the other belt which is mounted about a pressure roller and moves in engagement with a stationary guide. The drawing mechanism further includes a delivery couple defined by its own driving cylinder and its own pressure roller. At the inlet of the feed couple there are mounted a guiding member and a compacting member adapted to precompact the fibrous material being fed into the feed couple. The pressure roller of the feed couple, the stationary guide of the feed couple and the belt thereof, as well as the compacting member and the guiding member are mounted on a common removable plate provided with an adjustable structure for retaining such removable plate in a required position.

The disclosed arrangement of the components of the drawing mechanism enables speeding up the removal of the plate with the components mounted thereon, and moreover facilitates the maintenance and repairing of these components at a single working station, without the necessity of stopping or shutting down the entire machine.

The adjustable retainer structure may include a shaped portion of the side surface of the plate, interacting with a resiliently urged detent accommodated intermediate the shafts of the respective pressure rollers of the feed and delivery couples, on the internal surface of the housing.

With the adjustable retainer having this structure, it provides for the resilient urging of the pressure rollers, and should the fibers become wound about the roller, the structure would prevent the breakdown of the components of the drawing mechanism, so that the retainer enchances the durability of the mechanism, while retaining the removable plate in the operating position.

Alternatively, the adjustable retainer structure may include a shaped portion of the internal surface of the housing, interacting with a detent accommodated intermediate the side surface of the plate and the internal surface of the housing and mounted on the plate provided with a spring-biased catch, the catch and the detent being arranged at the opposite ends of the plate.

An advantage of the last-described adjustable retainer structure is the reliable retaining of the pressure rollers, their uniform urging against the cylinders, and, hence, the enhanced drawing conditions.

The detent of the adjustable retainer structure can be fixed either on the side surface of the plate, or on the internal surface of the housing. In this case, it is expedient that the detent be in the form of an eccentric cam.

This ensures the reliable retaining of the components of the drawing mechanism and of the plate, which maintains the permanent operational characteristics of the drawing process, due to the steady and uniform pressing effort of the pressure rollers.

With the pressing effort adjustable by varying the loading of the pressure rollers by rotating the eccentric detent, the output of the associated machine can be optimized for a broad range of fibrous materials being treated, by optimizing the drawing parameters.

Alternatively, the adjustable retainer structure may include the walls of a groove in the housing of the drawing mechanism.

With the retaining structure of this type, there is ensured the reliable retaining of the components of the mechanism, with the loading of the pressure rollers adjustable within a certain range, which is expedient for a corresponding range of drawing operations.

BRIEF DESCRIPTION OF THE DRAWINGS

The present invention will be further described in connection with its embodiments, with reference being made to the accompanying drawings, wherein.

DESCRIPTION OF THE PREFERRED EMBODIMENT

Figure 1:
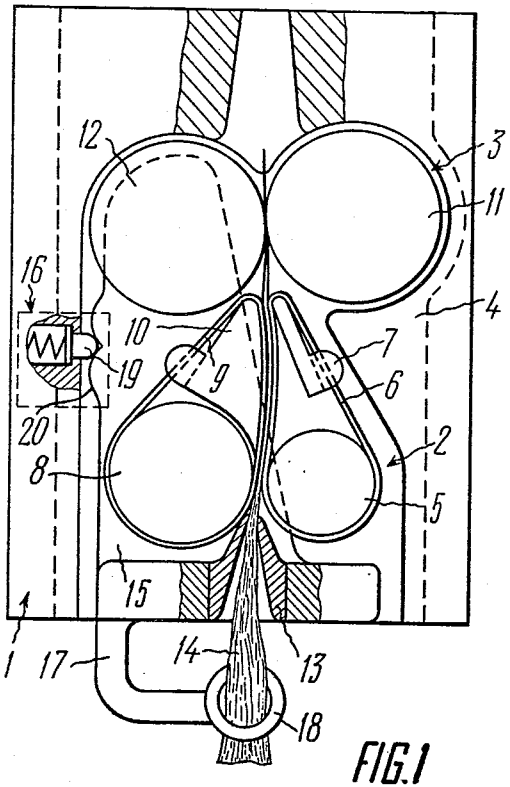
FIG. 1 is a general view of the drawing mechanism of the invention, including an adjustable retainer structure accommodated intermediate the shafts of the pressure rollers.

Referring now in particular to FIG. 1 of the drawings, there is generally indicated a drawing mechanism 1 comprising a feed couple 2 and a delivery couple 3 accommodated within a housing 4. The feed couple 2 includes a driving cylinder 5 rotatable by a drive motor (not shown), an endless belt running about this driving cylinder 5, and a movable guide 7 engaged by this belt 6. The feed couple 2 further includes a pressure roller 8, another endless belt 9 running about this pressure roller 8 and a stationary guide 10 engaged by this other belt 9.

The delivery couple includes its own driving delivery cylinder 11 rotatable by another drive motor (not shown, either) and its own pressure roller 12.

The drawing mechanism 1 further includes a compacting member 13 incorporated to pre-compact a fibrous material 14.

The roller 8 with its belt 9 and its guide 10, as well as the pressure roller 12 and the compacting member 13 are jointly mounted on a plate 15 retainable in the housing with the aid of an adjustable retainer structure 16. To facilitate removal and reinstallation of the components of the drawing mechanism 1, which are mounted on the plate 15, the drawing mechanism 1 is provided with a handle 17 supporting a member 18 for guiding the fibrous material 14.

In the embodiment of the invention illustrated in FIG. 1, the adjustable retainer structure 16 accommodated intermediate the respective shafts of the rollers 8 and 12 includes a spring-biased detent 19 mounted on the internal surface of the housing 4, and a shaped portion 20 of the side surface of the plate 15.

Figure 2:
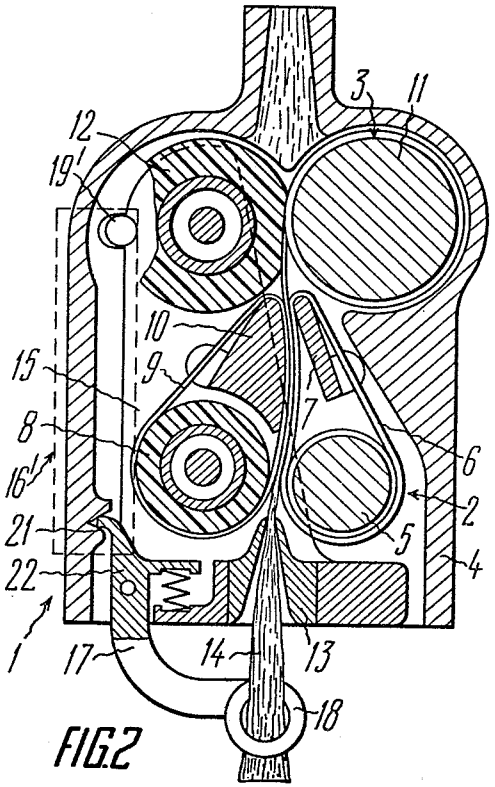
FIG. 2 is a general view of an embodiment of the drawing mechanism of the invention, wherein the adjustable retainer includes a spring-biased catch and a detent on the side surface of the plate, arranged at the opposite ends of the plate.

In another embodiment illustrated in FIG. 2, the adjustable retainer structure 16' includes a shaped portion 21 of the internal surface of the housing 4 and a detent 19' accommodated between the internal surface of the housing 4 and the side surface of the plate 15, this detent 19' being supported by the plate 15 further carrying a spring-biased catch 22, the catch 22 and the detent 19' being arranged at opposite ends of the plate 15.

Figure 3:
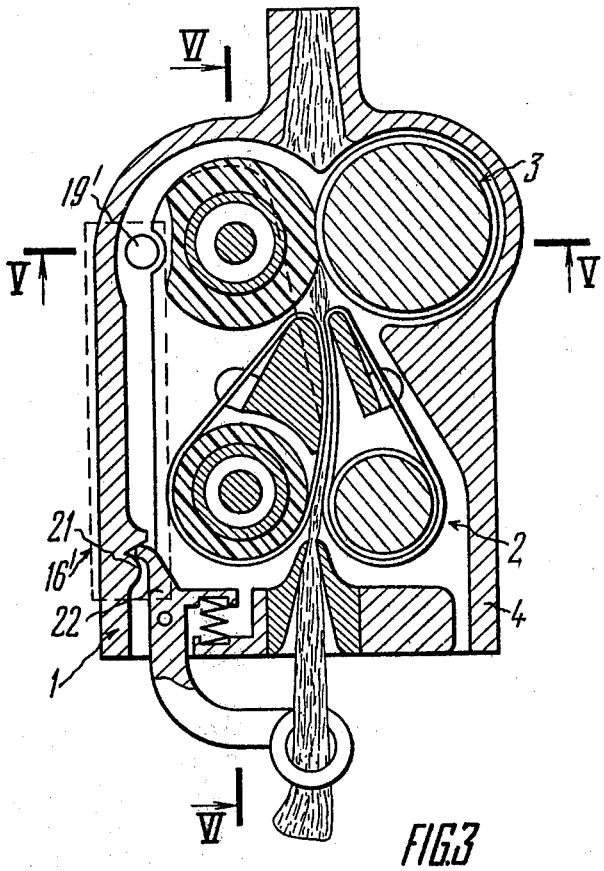
FIG. 3 is a general view of another embodiment of the drawing apparatus, wherein the adjustable retainer includes a spring-biased catch and a detent on the internal surface of the housing, arranged at the opposite ends of the plate.
Figure 6:
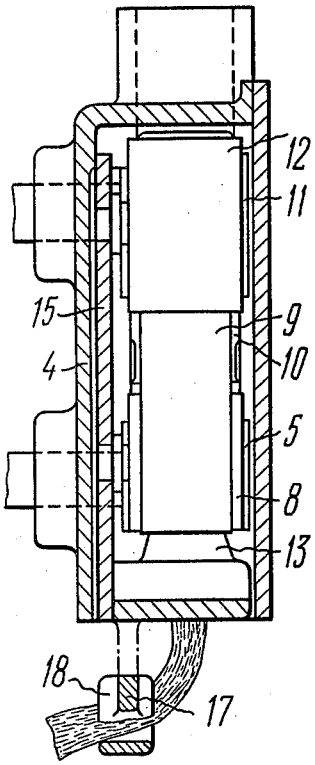
FIG. 6 is a sectional view taken along the line VI—VI of FIG. 3.
Figure 4:
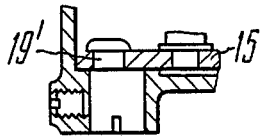
FIG. 4 illustrates the detent in the form of a rotatable eccentric cam.
Figure 5:
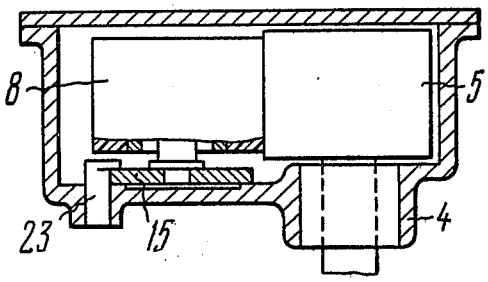
FIG. 5 is a sectional view taken along the line V—V of FIG. 3.

In this embodiment the detent 19', as it can be seen in FIG. 4, is in the form of a rotatable eccentric cam mounted on the side surface of the plate 15, as it is shown in FIG. 2; alternatively, like in the embodiment shown in FIG. 3, the detent 19' is accommodated on the internal surface of the housing 4.

Figure 7:
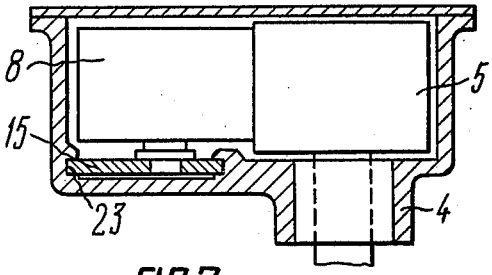
FIG. 7 is a cross-sectional view of a drawing mechanism, wherein the retaining structure includes the walls of a groove provided in the housing of the mechanism.

In the embodiment shown in FIG. 7, the drawing mechanism 1 comprises a retainer structure 16 including the walls of a guide slot 23 provided in the housing 4 longitudinally of the shafts of the pressure rollers 8 and 12.

The drawing mechanism 1 operates as follows.

The fibrous feed material 14 which may be sliver or roving is fed through the sliver guide 18 mounted in the handle 17 and through a compacting member 13 where the fibrous material 14 is compacted. Thereafter, it enters the nip of the feed belt couple 2 including the driving feed cylinder 5 rotating the belt 6 mounted thereabout, with the belt 6 moving in engagement with its guide 7. The belt 6 drives by friction engagement the other belt 9 running about the pressure roller 8 and engaging its stationary guide 10. Due to the load provided for by the adjustable retainer structure 16 including the detent 19 and the spring-biased catch 22, the drawing mechanism compacts the fibrous material 14. While moving in the nip of the belt couple, the fibrous material 14 is brought toward the friction nip of the delivery couple 3 made up of the driving delivery cylinder 11 and the pressure roller 12; with the speed of the delivery couple being higher than that of the feed one, the fibrous material becomes thinned and drawn.

Should it be necessary, e.g. when the fibrous material becomes wound about the elements of the drawing mechanism 1, or when a maintenance or repair operation is to be performed, which requires that the components of the drawing mechanism 1 should be removed, the handle 17 is pulled, whereby in the adjustable retainer structure 16 the spring-biased catch 22 is disengaged from the shaped portion 21 of the internal surface of the housing 4 (FIG. 2).

With the plate 15 thus released, the latter is removed jointly with the compacting member 13, pressure rollers 8 and 12, and belt 9 and guide 10 are carried thereby from the working area of the drawing mechanism 1 for maintenance, cleaning, repairs or replacement of the components, which does not call for halting the operation of the other units of the spinning frame.

The drawing mechanism 1 is reinstalled in the working position by mounting the plate 15 with the components carried thereby in the order reversed relative to the one described hereinabove.

The present invention can be utilized to the utmost effectiveness in ringless spinning frames operated at high spinning speeds, where stoppages are liable to sharply affect the throughput of the equipment.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. In an improved drawing mechanism embodying a ringless spinning frame comprising a housing accommodating therein a feed couple including two endless belts, one of said belts being mounted about a driving cylinder and adapted to move in engagement with a movable guide and to drive the other one of said two belts, mounted about the pressure roller of said feed couple and adapted to move in engagement with a stationary guide, and a delivery couple including its own driving cylinder and its own pressure roller adapted to pass therebetween a fibrous material coming from said feed couple, there being mounted at the inlet of said feed couple a guiding member and a compacting member adapted to effect the precompacting of the fibrous material being fed into said feed couple, the improvement comprising mounting said pressure roller of said delivery couple, and the pressure roller of said feed couple jointly with the stationary guide and the respective belt thereof, the compacting member and the guiding member on a resiliently biased common removable plate which is associated with an adjustable means for retaining said removable plate in a required position; whereby said pressure rollers are uniformly urged against said driving cylinders, thereby providing improved driving conditions, and a handle for said drawing mechanism which when pulled disengages the adjustable means for retaining said removable plate in place.

2. A drawing mechanism as set forth in claim 1, wherein said adjustable retaining means includes a shaped portion of the side surface of said removable plate, engageable by a spring-biased detent accommodated intermediate the pressure rollers of said feed couple and of said delivery couple on the internal surface of said housing.

3. A drawing mechanism as set forth in claim 1, wherein said retaining means includes a shaped portion of the internal surface of said housing, engageable by a spring-biased catch carried by said removable plate, and a detent supported by said removable plate and accommodated between the internal surface of said housing and the side surface of said plate, and said spring-biased catch and said detent being arranged at opposite ends of said plate.

4. A drawing mechanism as set forth in claim 3, wherein said detent includes a rotatable eccentric cam for varying the loading of said pressure rollers, and enabling a broad range of fibrous materials to be drawn by said mechanism.

5. A drawing mechanism as set forth in claim 4, wherein said detent is mounted on the side surface of said plate.

6. A drawing mechanism as set forth in claim 4, wherein said detent is mounted on the internal surface of said housing.

7. A drawing mechanism as set forth in claim 1, wherein said retaining means includes guide grooves provided in said housing longitudinally of the motion of the fibrous material.

* * * * *